United States Patent [19]

Kerr

[11] 4,244,426

[45] Jan. 13, 1981

[54] FIRE-FIGHTING APPARATUS

[76] Inventor: George E. Kerr, 2611 Mary Sue St., Largo, Fla. 33540

[21] Appl. No.: 29,300

[22] Filed: Apr. 12, 1979

[51] Int. Cl.[3] ..... A62C 25/00

[52] U.S. Cl. ..... 169/51; 248/90

[58] Field of Search ..... 169/51, 52, 23, 5; 248/90; 312/204, 242; 137/355.12, 355.16, 355.18, 355.2, 355.22

[56] References Cited

U.S. PATENT DOCUMENTS

| | | | |
|---|---|---|---|
| 1,241,605 | 10/1917 | Barcus | 248/90 |
| 1,600,468 | 9/1926 | Henneboble | 169/23 |
| 3,918,782 | 11/1975 | Allmand | 248/90 |
| 4,018,242 | 4/1977 | Schlegel | 169/51 |
| 4,062,493 | 12/1977 | Suggs | 169/51 |

*Primary Examiner*—Robert J. Spar
*Assistant Examiner*—Kenneth Noland
*Attorney, Agent, or Firm*—Gust, Irish, Jeffers & Hoffman

[57] ABSTRACT

A fire-fighting apparatus particularly for homes comprising a cabinet having a door affording access to a water hose, operating valve and fire extinguisher in the cabinet. The cabinet is divided into three compartments, the first containing a fire hose, the second a valve assembly connected to the fire hose, and the third a chemical extinguisher. The compartment containing the valve assembly opens into the fire hose compartment to accomodate a connection between the fire hose and the valve assembly. A cover plate is hingedly mounted on the cabinet unit to overlie the valve assembly, and more particularly the operating handle thereof. A spring in the hinge urges the cover plate in a direction to uncover the handle; however, the cover plate has a portion extending between the fire hose and valve assembly compartments which is engageable by the fire hose when in its compartment to hold the cover plate in overlying relation to the handle. Thus, unless the fire hose is withdrawn from its compartment, the cover plate will overlie the handle and serve as a safeguard against operation of the handle while the fire hose is still in the compartment.

An electrical switch is mounted on the valve assembly in operative association with the handle such that operation of the handle serves in activating the switch. The switch may be connected to any suitable alarm device, including a bell, siren, lights, automatic telephone-dialing system and the like.

13 Claims, 12 Drawing Figures

FIG. 1
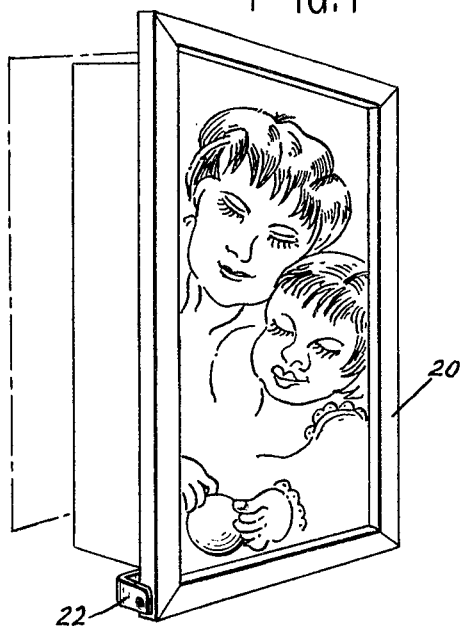
FIG. 11
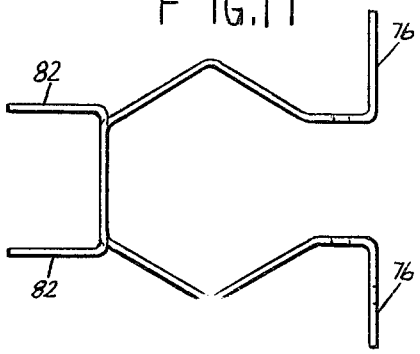
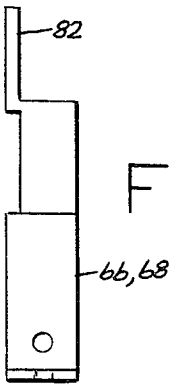
FIG. 12
FIG. 9
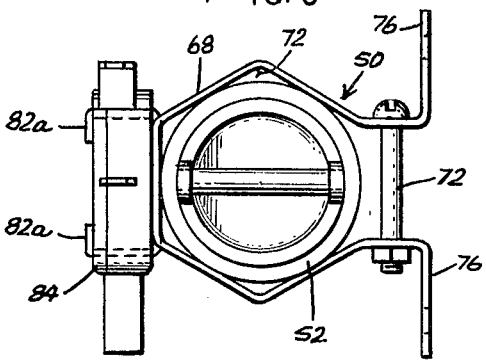
FIG. 8
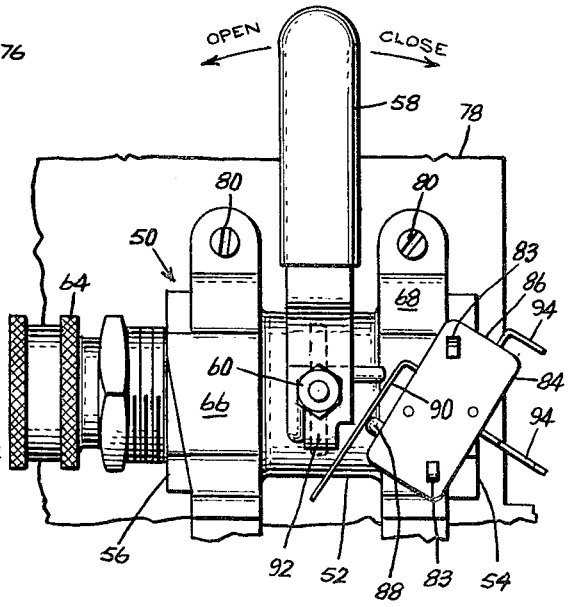
FIG. 10
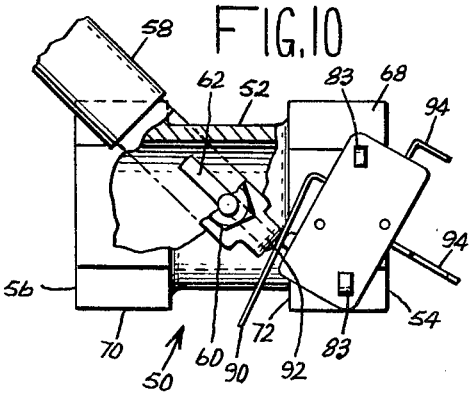

FIRE-FIGHTING APPARATUS

BACKGROUND OF THE INVENTION

1. Field of the Invention

The present invention relates to fire-fighting apparatus and more particularly to an apparatus particularly designed for home use for use in attacking small fires at the inception thereof.

2. Description of the Prior Art

Fire-fighting apparatus for home use are known, typical of these being disclosed in U.S. Pat. No. 3,918,782. Generally speaking, this prior art apparatus includes a cabinet having two upstanding, spaced apart guide rails mounted therein. The guide rails provide a vertical channel and storage way for a flexible fire hose having reversely folded sections. Between one guide rail and one cabinet side is securely mounted a water chamber device to which is connected an upstanding feed pipe and a parallel depending outlet pipe. A hand operated valve is connected to the depending pipe and is further connected to one end of the fire hose. A cover for the cabinet is hingedly mounted thereon at the bottom which upon being opened swings to a depending position thereby providing unencumbered access to the cabinet interior.

In still another prior art apparatus, included in addition to the foregoing, a cover plate hinged to the cabinet normally overlies the water chamber, the upstanding feed pipe, the depending outlet pipe and the hand operated valve, this cover plate being spring urged in a direction to uncover these components. The fire hose, however, when coiled and contained within the cabinet engages a portion of the cover plate holding it closed. When the hose is removed from the cabinet, the cover plate is released such that it swings away from the covered components to provide access thereto, and more especially the hand operated valve.

The aforesaid components which include the water chamber, the feed and outlet pipes and the hand operated valve are contained within a section of the cabinet disposed to one side of the section defined by the previously mentioned guide rails. The cover plate is so designed as to cover this entire component compartment which must be relatively large to provide space for the components. The number and size of the components tends to increase the complexity of the design as well as the cost.

SUMMARY OF THE INVENTION

This invention is a fire-fighting apparatus primarily designed for home use. The apparatus includes a cabinet having a door hingedly mounted along the bottom edge which upon being opened depends from the cabinet to thereby expose the interior. The cabinet is provided with at least two and preferably three adjacent compartments with a feed-through opening between two of these, one of the two being adapted to store a flexible fire hose and the other a manually operable water valve assembly. The third chamber can be used to store a chemical fire extinguisher.

The valve assembly has inlet and outlet sides, the outlet side being disposed adjacent the aforesaid feed-through opening with one end of the hose being connected therethrough. The cabinet is also provided with an opening adjacent the inlet side of the valve assembly for receiving the end of a water main to be connected thereto. A pivotally mounted operating handle forms a part of the valve assembly. A cover plate is hingedly mounted on the cabinet to overlie the handle, spring means urging the cover plate in the direction to uncover the handle. Further, the cover plate is provided with a portion within the feed-through opening which is engageable by the water hose when the latter is stored in its compartment thereby to hold the cover plate in a position to overlie the handle. Thus, the handle is made accessible for operation only when the firehose is removed from the cabinet.

An electrical switch is securely mounted on the valve assembly for operation by the handle when it is swung between its closed and open positions. A projection on the handle is disposed to engage an operating arm on the switch such that upon swinging the handle in one direction the switch is closed and in the opposite direction is opened. Suitable alarm equipment is connected to the switch, this equipment including such devices as bells, sirens, lights, automatic dialing devices for telephones and the like.

Unique clamping brackets are utilized for securing the valve assembly to the cabinet. The brackets include metal straps which partially encircle and clamp onto the valve body with arm portions extending therefrom for secure attachment to the bottom of the cabinet. Upstanding tabs on the brackets are used for securing the switch to the valve assembly.

It is an object of this invention to provide a simple, economical and dependable fire-fighting apparatus for home use in attacking small fires at the inception thereof. Another object is to provide apparatus having a manually operable valve in combination with an electrical switch for sounding an alarm automatically when the valve is turned "on" thereby assuring that an alarm has been given when the apparatus is first put into use.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

In the drawings,

FIG. 1 is a perspective illustration of one embodiment of this invention.

FIG. 8 is a front fragmentary view of the hand operated water valve as mounted in the cabinet;

FIG. 9 is an end view of the water valve showing a mounting bracket and switch secured thereto;

FIG. 10 is a fragmentary view of the water valve itself with an electrical switch mounted thereon and the handle moved to the position at which the switch is activated in one direction;

FIG. 11 is a front view of a bracket for mounting the valve and the electrical switch; and FIG. 12 is a side view thereof.

DESCRIPTION OF THE PREFERRED EMBODIMENT

Figure 4:
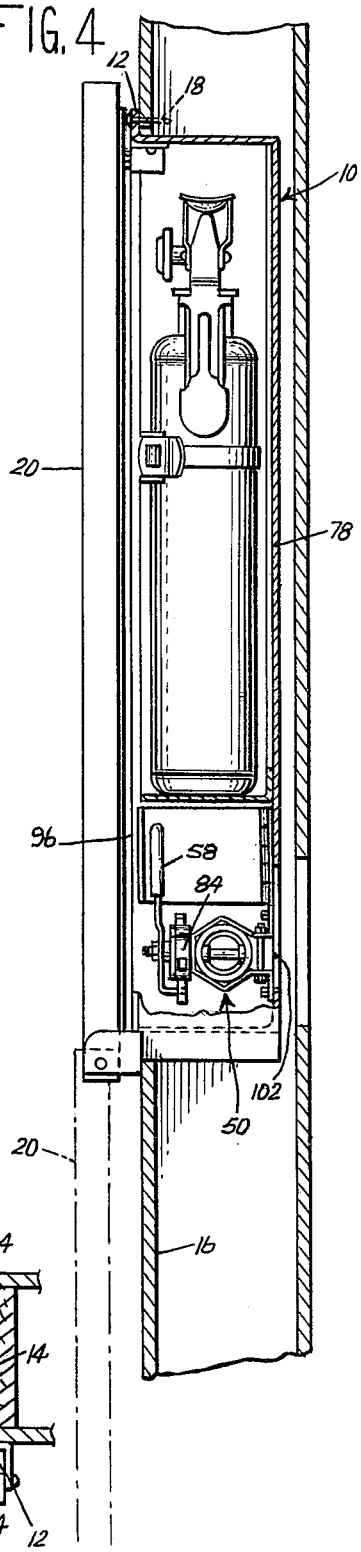
FIG. 4 is a fragmentary sectional view taken substantially along section line 4—4 of FIG. 3.
Figure 3:
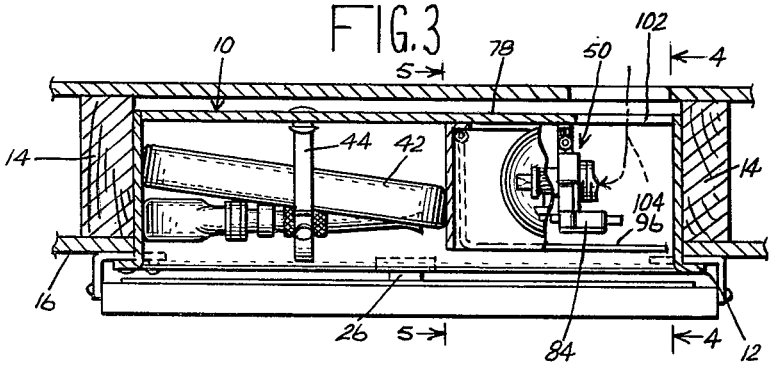
FIG. 3 is a fragmentary sectional view taken substantially along section line 3—3 of FIG. 2 and with the apparatus of this invention mounted between two studs in a wall.
Figure 5:
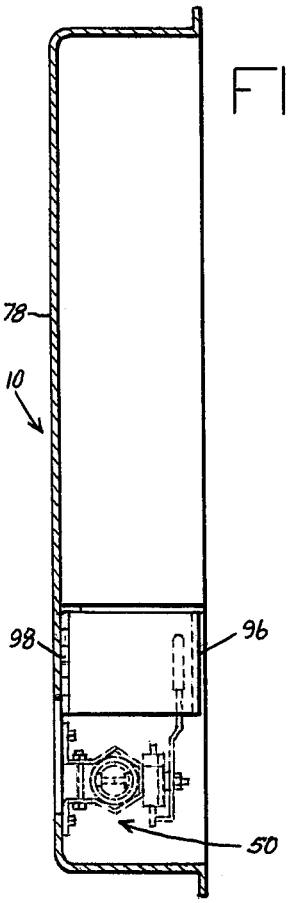
FIG. 5 is a sectional view taken substantially along section line 5—5 of FIG. 3.

Referring to the drawings, the household fire-fighting apparatus of this invention is shown as including a sheet metal cabinet 10 having an outwardly flared mounting flange 12. The cabinet 10, as shown more clearly in FIGS. 3 and 4, is adapted to be recessed into a suitable wall opening with the sides of the cabinet slidably engaging two wall studs 14 and the flange 12 operatively abutting against the front wall panel 16. The cabinet may be secured to the wall by means of threaded fasteners 18 passing through the flange 12 and into the panel 16 as shown.

Figure 2:
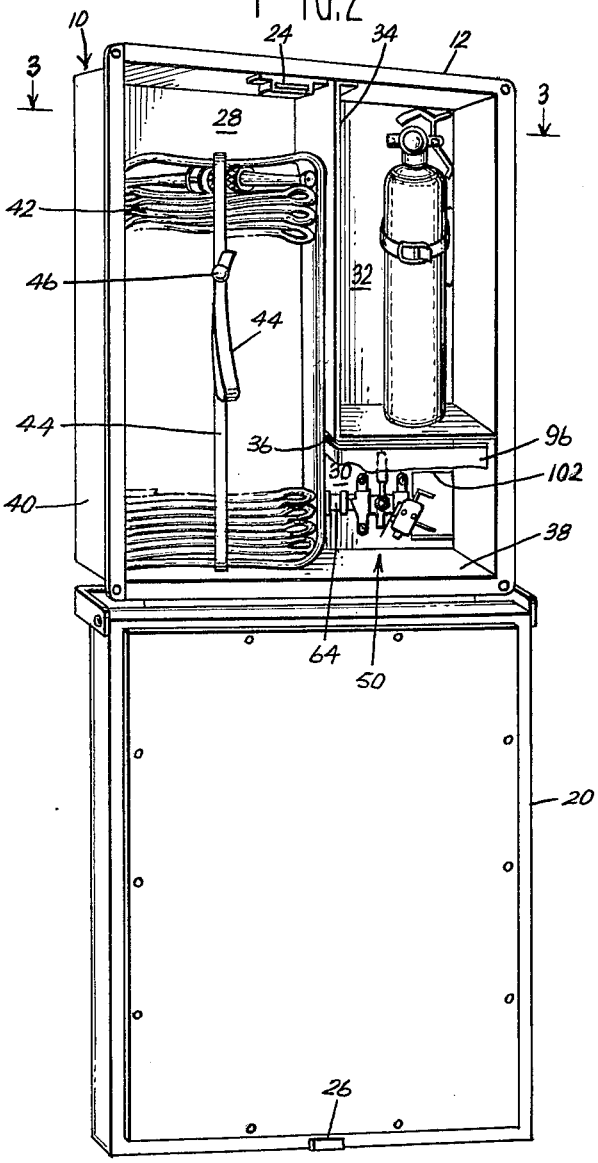
FIG. 2 is a similar illustration with the access door in open position and with the safety cover plate removed to provide a clearer view of the hand operated valve assembly.

A door 20 is hinged to the bottom of the cabinet 12 by means of a suitable mounting bracket 22 to be swung into closed position as shown in FIG. 1 and to depending open position as shown in FIG. 2, the door 20 being somewhat larger than the cabinet itself to overlie and hide the cabinet and further to provide a suitable mounting for a picture which serves as a part of the interior decorations of the household. A suitable catch assembly 24, 26 of the spring or magnetic type is used for holding the door 20 in closed position and may be released by merely grasping the door and swinging it to the position shown in FIG. 2.

The cabinet 10 is divided preferably into three compartments denoted by the numerals 28, 30 and 32. These compartments are defined by essentially a single, L-shaped partition 34 suitably secured to the cabinet by means of welding or threaded fasteners, the size, shape and relationship of the cabinet and the compartments being as shown in the drawings which are substantially to scale. The partition 34 is combination with portions of two of the cabinet sides define the compartment 32, the remaining two compartments 28 and 30 being defined with the remaining portions of the cabinet side walls. As shown clearly in FIG. 2, the two compartments 28 and 30 are in open communication, a feed-through opening 36 being provided therebetween. This opening 36 is defined between the corner of the partition 34 and the opposite cabinet side 38, this side 38 also being common to the two compartments 28 and 30.

The compartment 28 defined between the cabinet side 40 and the parallel extending portion of the partition 34 is adapted to receive therein a flexible firehose 42 having reversely folded sections as shown in FIG. 2 in neatly stacked relationship. A flexible strap 44 having its opposite ends secured to the cabinet 10 passes around the stacked hose 42 to hold the latter in the compartment 28, the other ends of the strap being releasably fastened together by means of a conventional snap 46 which can easily be disengaged by manually jerking upwardly on the strap end 48. The hose may thereupon be easily be removed from the compartment 28 by the user grasping the nozzle and pulling it forwardly.

A manually operable, water valve assembly indicated generally by the numeral 50 is mounted in the compartment 30 as shown. This assembly is of conventional construction and includes, as shown more clearly in FIGS. 8 to 10, a valve body 52 having inlet and outlet sides 54 and 56, respectively, and an operating handle pivotally mounted thereon by means of threaded fasteners 60 connected through the wall of the valve body 52 to an internal butterfly valve 62. This pivotal connection is such that upon moving the handle 58 as viewed in FIG. 8 between left and upright positions, the butterfly valve 62 is moved between opened and closed positions, respectively.

Figure 6:
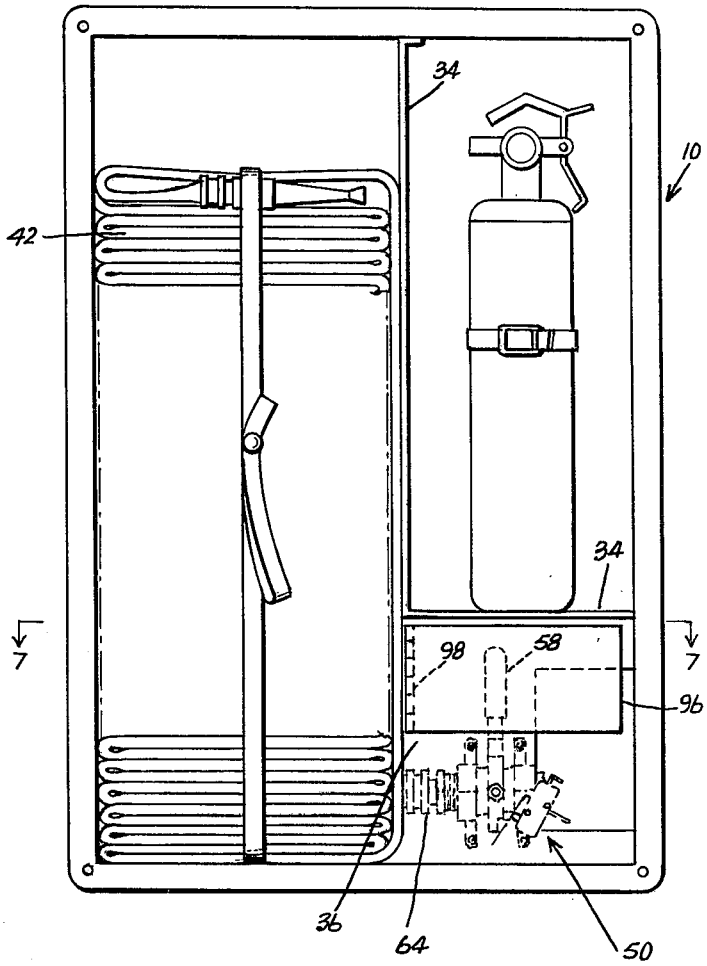
FIG. 6 is a front view showing the various compartments and the safety cover plate overlying the handle of the manually operated water valve.

As shown more clearly in FIGS. 2 and 3, one end of the fire hose 42 is connected to the outlet side 56 of the valve assembly by means of a suitable threaded fitting 64. This fitting 64 is positioned essentially within the feed-through opening 36 as shown more clearly in FIGS. 2 and 6. The valve 52 may be further characterized as being substantially straight with the inlet and outlet sides 54, 56 being at the opposite ends. As mounted within the compartment 30, the valve is arranged substantially parallel to the cabinet side 38 and immediately thereabove. Holding the valve assembly in position are two mounting brackets 66 and 68 which are identically constructed except for certain mounting tabs to be described later. These brackets 66, 68 are formed of sheet metal to hexagonal shapes which are complementary with the hexagonal shapes of the valve ends 70 and 72, respectively. The brackets 66 and 68 are fitted about the respective ends 70 and 72 as shown and are there clamped into place by means of threaded fasteners 74. Outwardly flared mounting arms or flanges 76 are provided on the ends of the brackets to lie flat against the bottom wall 78 of the cabinet where they are secured by means of threaded fasteners 80. This results in securely mounting the valve body 52 onto the cabinet.

The bracket 68 has two upstanding tabs 82 thereon which are used to mount an electrical switch 84 on the valve assembly 50. The tabs 82 are received through openings 83 in the switch body 86 with the ends **82*a* being bent over as shown more clearly in FIG. 9 thereby to clamp the switch 84 on top of the bracket 68. This results in the switch 84 being firmly clamped to the valve body 52 and attached to the valve assembly 50. The switch 84 of conventional construction is commonly referred to as a snap action switch and includes a plastic housing 86 which carries internally thereof electrical contacts (not shown) which may be manually opened and closed by operating a plunger 88 spring biased to one position. An operating arm 90 secured at one end to the housing 86 overlies the plunger 88 and is disposed to be engaged by a projection 92 on the end of the handle 58. When the handle 58 is swung leftwardly as shown in FIGS. 8 and 10, the projection 92 engages the arm 90 depressing the plunger 88 causing closure of the internal contacts. When swung rightwardly to the position shown in FIG. 8, the projection 92 disengages from the arm 90 thereby permitting the plunger 88 to protract and to open the contacts. Thus, movement of the handle 58 between open and closed conditions serves in activating the switch 84**.

The switch 84 is further provided with two circuit terminals 94 to which an external alarm such as a bell, siren or automatic dialer for a telephone which functions as a result of moving the lever 58 from its closed position as shown in FIG. 8 to its open position as shown in FIG. 10.

This assures that when the apparatus is first operated in a panic situation, which operation includes the opening of the water valve, an alarm will be sounded automatically while the user is directing his attention toward fighting the fire. In the situation in which the switch 84 is used to activate an automatic telephone dialing system, an alarm can be sounded at a nearby fire station which will result in the community fire fighting equipment being called to fight the fire.

Figure 7:
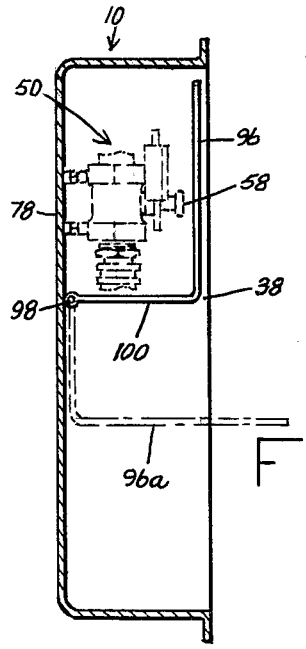
FIG. 7 is a sectional view taken substantially along section line 7—7 of FIG. 6.

When the hose 42 is stored in its compartment 28, it is important that the valve assembly 50 not be operated to apply water pressure to the hose 42. If this were to occur, the hose would distend while in its folded condition and become so tightly wedged within the compartment 28 that it would be almost impossible to withdraw. Therefore, means should be provided to safeguard against operation of the valve assembly 50 while the hose 42 is still in its compartment 28. This safeguard is provided by an L-shaped, safety guard or cover plate 96 which is connected to the bottom wall 78 of the cabinet by means of a spring hinge 98. The portion 100 of the cover plate 96 is so sized and shaped as to be an extension of the longer portion of the partition 34, this portion 100 thereby serving as a part of the righthand side of the compartment 28 as viewed in FIGS. 2 and 6. The other portion of the cover plate 96 is straight as shown in FIG. 7 and is so positioned as to overlie in spaced relation and further to fully cover the operating handle 58. Thus with the cover plate 96 in the position shown in FIGS. 6 and 7, it would be impossible for a person to grasp the handle 58 and open the valve.

The spring hinge 98 is so arranged as normally to swing the partition 96 from its solid line to its dashed line position **96*a*. The hose 42 stored in the compartment 28 has a number of its coils in engagement with the portion 100 of the plate 96 thereby holding it in the full line position in which the handle 58 is guarded. When the hose, however, is withdrawn from the compartment 28, the safety cover 96 is free to spring to the dashed line position 96*a* (FIG. 7) thereby fully exposing the handle 58. The handle 58 may now be grasped by the user to open the valve and to connect the hose to a source of water under pressure. Thus, the safety cover 96 assures that the hose will be removed prior to the time the water valve is operated. This renders the apparatus safer and more foolproof in operation and assures that operation can be effected in a minimum of time which is so essential in fighting a fire Referring to FIGS. 2 and 8, it will be noted that the outlet side 54 of the valve assembly 50 is disposed immediately adjacent to an opening 102 in the cabinet bottom 78. This opening 102 is adapted to receive one end of the water main indicated by the numeral 104 which can be permanently connected to the inlet side 54 of the valve assembly. Water pressure is thus applied to the valve assembly continuously and is ready to be used upon moving the handle 58 to open position. Instead of the opening 102 being in the bottom wall 78, it may also be in the side 32 or some other portion of the cabinet immediately adjacent to the inlet side 54** of the valve assembly.

It will now further be noted that the safety plate 96 does not overlie the entire valve assembly 50 but only that portion of the handle 58 which is to be grasped and operated by the user. The valve assembly 50 is for the most part situated beneath the safety plate 96 such that when the hose 42 is removed from its compartment 28, there is nothing to interfere with the swinging movement of the plate 96 to its dashed line position **96*a* as shown in FIG. 7. Furthermore, by the valve assembly 50 being exposed, it can be serviced while the hose 42 is still in the compartment 28**.

While there have been described above the principles of this invention in connection with specific apparatus, it is to be clearly understood that this description is made only by way of example and not as a limitation to the scope of the invention.

What is claimed is:

1. Fire-fighting apparatus comprising a cabinet unit provided with a bottom and sides, the front of said unit being open, said unit being adapted to be positioned with said bottom and open front arranged vertically, an access door hingedly mounted on one side and swingable to open and close said open front, said unit having therein at least two laterally adjacent compartments with a feed-through opening therebetween, a side of each compartment being a cabinet unit side, a water hose contained within one compartment and a manually operable water valve assembly disposed in the other, means for securing said valve assembly to said cabinet unit, said valve assembly having inlet and outlet sides, the outlet side being disposed adjacent said feed-through opening with one end of said hose being connected thereto, said valve assembly including an operating handle, a cover plate hingedly mounted on said cabinet unit to overlie said handle, spring means urging said cover plate in a direction to uncover said handle, and said cover plate having a portion within said feed-through opening which is engageable by said water hose when the latter is stored within said one compartment to hold said cover plate in position to overlie said handle, said securing means including a mounting bracket which partially surrounds said valve assembly and is secured to said bottom by means of threaded fasteners, said valve assembly including a valve body and having two arm portions which are secured to said bottom by means of said threaded fasteners.

2. The apparatus of claim 1 including an electrical switch having a switching arm, said switch being mounted on said valve assembly, a portion of said handle being engageable with said switching arm for activating said switch when said handle is moved between opened and closed positions, means for securely fastening said switch to said bracket, and means on said handle engageable with said switching arm for activating said switch when said handle is moved between opened and closed positions.

3. The apparatus of claim 2 wherein said fastening means includes two upstanding tabs on said bracket which are received through two openings in said switch and then bent over thereby fastening said switch to said bracket.

4. The apparatus of claim 3 wherein said handle means includes a projection on one end thereof, said handle being pivotally mounted between its ends onto said valve body, said projection being engageable with said switch arm to actuate said switch.

5. The apparatus of claim 4 wherein the exterior of said valve body has hexagonally shaped portions on opposite sides of said handle, a second clamp like the first clamped on said valve body and secured to said bottom, both said clamps being clamped about the hexagonal portions of said valve body and having shapes complementing the same, said switch being fastened to one of said brackets with the switching arm thereof extending into the region between said brackets, said bracket arms of each bracket having a threaded fastener extending therethrough for clamping the bracket onto said valve body, the distal end portions of said arms being flared outwardly to lie flat against said bottom, and said threaded fasteners extending through said distal end portions.

6. The apparatus of claim 1 wherein said cover plate is L-shaped with one end hingedly mounted onto said bottom, said spring means includes a spring hinge, one leg portion of said cover plate extending perpendicular to said bottom when the other leg is disposed in overlying relation to said handle, said one leg portion closing only that portion of said feed-through opening which is to one side of the connection between said hose and outlet side such that said cover plate does not interfere therewith.

7. The apparatus of claim 6 wherein said cabinet unit has a third compartment adjoining the other two compartments, said other compartment being disposed between said third compartment and said one side of said cabinet unit, said valve assembly being an elongated unit with said inlet and outlet sides at the opposite ends thereof, and said valve assembly extending parallel to said one side first mentioned of said cabinet unit.

8. Fire-fighting apparatus comprising a cabinet unit provided with a bottom and sides, the front of said unit being open, said unit being adapted to be positioned with said bottom and front arranged vertically, an access door hingedly mounted on one side and swingable to open and close said front, said unit having therein at least two laterally adjacent compartments with a feed-through opening therebetween, a water hose contained within one compartment and a manually operable valve assembly disposed in the other, at least one bracket firmly clamped onto said valve assembly and secured to said bottom for mounting said valve assembly on said cabinet unit, an electrical switch having a switch-activating portion secured to said bracket, said valve assembly including an operating handle engageable with said switch-activating portion for actuating said switch when said handle is moved between opened and closed positions, said switch being secured to said bracket by means of two upstanding tabs thereon which are received through two openings, respectively, in said switch, said tabs being bent over onto said switch for clamping it onto said bracket.

9. The apparatus of claim 8 wherein said valve assembly includes a valve body provided with hexagonally shaped portions on opposite sides of said handle, said handle being pivotally mounted on said valve body, a second clamp like the first clamped on said valve body and secured to said bottom, both said clamps being clamped about the hexagonal portions of said valve body and having shapes complementing the same, said switch-actuating portion including a switching arm extending into the region between said brackets, and said handle having a portion thereon engageable with said switching arm for actuating said switch.

10. Fire-fighting apparatus comprising a cabinet unit provided with a bottom and sides, the front of said unit being open, said unit being adapted to be positioned with said bottom and front arranged vertically, an access door mounted on one side and movable to open and close said open front, said unit having therein at least two laterally adjacent compartments, a water hose contained within one compartment and a manually operable valve assembly fixedly disposed in the other, said valve assembly and said hose being connected, said valve assembly having a manually operable handle, an electrical switch device having a switch-activating portion operatively associated with the handle of said valve assembly whereby operating said handle serves in actuating said switch device, a guard operatively mounted on said cabinet unit for movement between first and second positions, said guard in said first position being juxtaposed with respect to said handle to preclude manual operation thereof, said guard further in said first position exposing said switch device for manual access thereto, said guard in said second position being spaced from said handle to provide manual access thereto, and means for holding said guard in said first position when said hose is contained within said one compartment and for moving said guard to said second position when said hose is withdrawn from said one compartment.

11. The apparatus of claim 10 wherein said guard is in the form of a cover which overlies said handle in said first position; said means including a hinge mounting said cover onto said cabinet unit and spring means for yieldably urging said cover from said first to said second position, and said hose when contained within said one compartment being engageable with said cover to hold the latter in its first position.

12. The apparatus of claim 11 wherein said switch device is exposed for manual access in both positions of said cover, said switch device being fixedly secured relative to said valve assembly, said handle having a portion operatively engageable with said switch-activating portion for actuating said switch device when said handle is moved to valve-opening position.

13. The apparatus of claim 11 wherein said cover is L-shaped with one leg portion overlying said handle when in said first position and with the other leg portion being hingedly connected to said cabinet unit, said hose being engageable with said other leg portion while within said one compartment to hold said cover in said first osition.

* * * * *